United States Patent [19]

Borneman

[11] 4,018,158

[45] Apr. 19, 1977

[54] UNIVERSAL MASTER CYLINDER FOR OFFSET PRESSES

[75] Inventor: Lawrence A. Borneman, Lombard, Ill.

[73] Assignee: A. B. Dick Company, Chicago, Ill.

[22] Filed: Dec. 29, 1975

[21] Appl. No.: 644,931

[52] U.S. Cl. ..... 101/132.5; 101/378; 101/415.1

[51] Int. Cl.[2] ..... B41F 1/28

[58] Field of Search ..... 101/130, 131, 131.5, 101/132, 142, 217, 132.5, 378, 415.1, 408, 409, 410, 232; 271/80, 81, 82

[56] References Cited

UNITED STATES PATENTS

| | | | |
|---|---|---|---|
| 3,158,091 | 11/1964 | Matthews et al. | 101/132.5 |
| 3,540,376 | 11/1970 | Corse | 101/415.1 |
| 3,744,413 | 7/1973 | Wolff | 101/142 |
| 3,865,362 | 2/1975 | Luffy et al. | 271/82 |
| 3,896,728 | 7/1975 | Nakagawa | 101/378 X |

*Primary Examiner*—Edward M. Coven
*Attorney, Agent, or Firm*—Peter S. Lucyshyn

[57] ABSTRACT

A master cylinder for an offset or the like printing press includes an arcuate master receiving surface extension section mounted on the cylinder for movement between an inoperative position into the interior of the cylinder and an operative position adjacent the tail end of the stationary master receiving surface of the cylinder. When in the operative position the extension section increases the length of the master sheet receiving surface of the cylinder to accommodate longer than "standard" length master sheets. The extension section is mounted for sliding movement on arcuate guides formed by the movement of a predetermined radius extending from a point off center with respect to the central axis of the cylinder. A locking assembly is included to secure the section in either position. A tail clamp for longer masters is provided on the free end of the extension section. The standard tail clamp is also mounted for movement from an inoperative position adjacent the tail end of the stationary master receiving surface of the cylinder to a position within the cylinder to permit movement of the extension section to an operative position. In a preferred embodiment, a pivotal assembly within the cylinder is coupled both to the extension section and the standard tail clamp to move the latter into an inoperative position simultaneously with the movement of the extension section to an operative position and vice versa.

17 Claims, 9 Drawing Figures

UNIVERSAL MASTER CYLINDER FOR OFFSET PRESSES

BACKGROUND OF THE INVENTION

This invention relates generally to the master cylinder of an offset or the like printing press and more particularly to such a master cylinder which includes means for changing the length of the surface thereof provided for receiving master sheets thereby to accommodate sheets of different lengths.

Conventionally, master cylinders used in offset and the like printing presses are provided with a master receiving surface of a predetermined length. At each end of the surface of the cylinder there is provided a clamping member for holding the lead and trailing ends, respectively, of the sheet. The cylinder is not constructed to receive a master sheet of a length different than that for which it was designed. Thus, persons using an offset and the like press of the type described are restricted for the most part to using master sheets of a length which corresponds to the particular master cylinder included in the press.

The prior art reveals various schemes for accommodating different size master sheets on a single master cylinder. One such scheme employs an arcuate cylinder section which is removably attached to a master cylinder to accommodate a longer than "standard" master sheet. While this scheme provides high quality printing, the attachment and removal of the section including the trailing end clamp normally coupled to the stationary master receiving surface of the cylinder, is time-consuming and the section can be easily damaged in the process. Futhermore, once the section is removed from the cylinder, there is the problem of storage thereof in a safe place.

SUMMARY OF THE INVENTION

Accordingly, it is a primary object of the present invention to provide a master cylinder for an offset or the like printing press which includes means for changing the length of the master sheet receiving surface of the cylinder while avoiding the disadvantages of the prior art scheme described.

It is another object of the present invention to provide a master cylinder of the above-described type including means therein for quickly and easily changing the length of the master sheet receiving surface.

It is still another object of the present invention to provide a master cylinder of the last-mentioned type wherein the means for changing the length of the master sheet receiving surface is relatively simple in construction and reliable in operation.

Briefly, a preferred embodiment of a master cylinder according to the invention includes a stationary outer master receiving surface extending a predetermined distance about the periphery thereof. At each end of the master receiving surface there is provided a clamp, one being for the retention of the leading end of a master sheet and the other being for the retention of the trailing end of the master sheet. The particular length of the stationary master receiving surface is made to accommodate a standard master sheet length.

Mounted internally of the cylinder is an arcuate cylindrical surface section. The section is mounted for movement between a position whereat the section is moved into the confines of the cylinder or to a position engaging the stationary master receiving surface of the cylinder in coupled relation therewith to provide an extension of the master receiving surface for accommodating predeterminedly larger than standard master sheets. An extra sheet clamp member is included on the free end of the cylinder section for use as a tail clamp for the longer master sheets.

The tail clamp member used for holding the trailing end of standard master sheets is also mounted for movement out of position at the end of the stationary master receiving surface and into the confines of the cylinder to permit the coupling of the movable arcuate cylinder section with the stationary surface of the cylinder when it is desired to extend the master receiving surface.

The standard sheet tail clamp member is mounted within the cylinder for pivotal movement. The arcurate cylinder section is movable on arcuate guides formed about a center point offset with respect to the center of rotation of the master cylinder and is connected to a pivotally movable mounting member at the end of a first arm thereof. A second arm of the mounting member is coupled to the standard sheet clamp member so that upon moving the arcuate cylinder extension section along the guides into an operative position in coupling engagement with the stationary master receiving surface of the cylinder, the last-mentioned sheet clamp member is pivoted into the confines of the cylinder.

Means are included to secure the arcuate cylinder section in both positions to avoid movement thereof during the operation of the printing press.

DETAILED DESCRIPTION OF THE DRAWINGS

Figure 1:
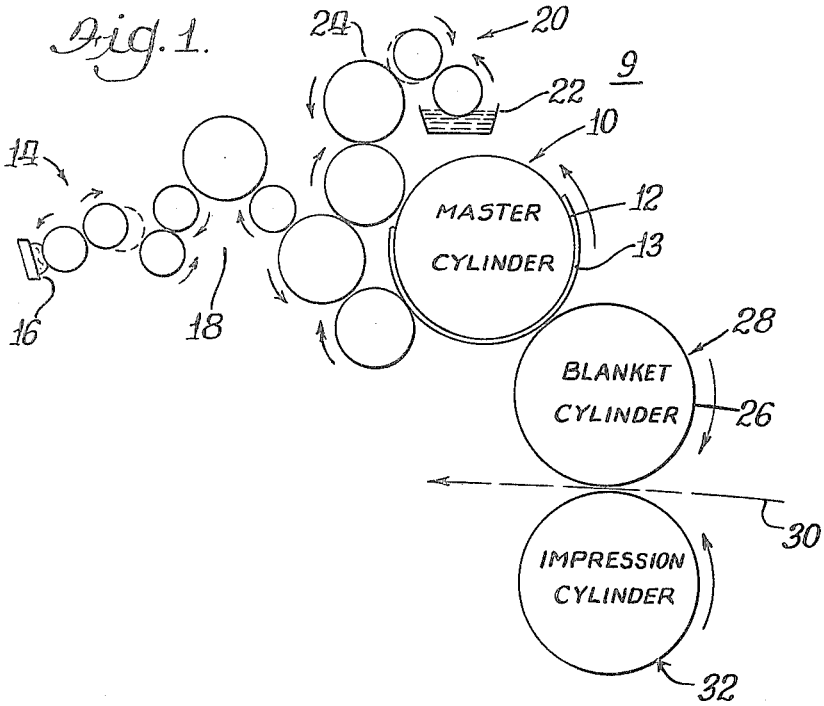
FIG. 1 is a diagrammatical representation of an offset printing press including the master, blanket and impression cylinders thereof.

Referring now to the drawings in greater detail wherein like numerals are employed throughout the various views to designate similar componets, there is shown in FIG. 1 in diagrammatical form, a representation of the basic elements comprising an offset printing press 9. The press includes a master cylinder 10 on which there is mounted about the peripheral master receiving surface 12 thereof, a master sheet 13 from which copies are made. An inking system 14 includes an ink fountain 16 from which ink is supplied via the ink train rollers 18 to the master sheet 13 for inking the oleophilic image areas thereof. A moisture dispensing system 20 supplies water or fountain solution from the fountain trough 22 thereof via rollers 24 to the master sheet 13 for receipt by the hydrophilic background regions thereof.

In a well known manner, the inked image of the master sheet is transferred to the rubber or the like surface 26 of blanket cylinder 28 rotating in engagement with the master cylinder. Sheets of paper or the like material are fed along a path illustrated by arrow 30 between the blanket cylinder 28 and an impression cylinder 32 and are urged by the latter into engagement with the rotating blanket cylinder. The inked image is thereby transferred from the blanket cylinder to the sheets as they pass between the blanket and impression cylinders.

In many offset presses of the type described, the master sheet receiving surface of the master cylinder is of a fixed length to accommodate standard 10 inches wide by 15 inches long master sheets. Both a head and tail clamp on either end of the master receiving cylinder surface is provided to hold respective ends of the master sheet for securing the sheet onto the cylinder surface. In such cases, the operator is for the most part restricted to using a master sheet no greater in length than that for which the cylinder is designed.

The master cylinder according to the invention overcomes the latter by permitting an operator to use both standard size master sheets and those of a longer length (i.e. 12.75 inches wide by 18.5 inches in length).

Referring to the remaining figures of the drawings, there is illustrated therein a master cylinder 34 according to the invention. The master cylinder 34 includes a hollow cylindrical segment 36 including a stationary master sheet receiving surface 38 of a first predetermined length formed thereon on which a master sheet of a corresponding length is fastened during the printing operation. The stationary cylinder segment is formed of a cast material such as, iron, aluminum or the like. End plates such as 39 are provided at opposite ends of the cylinder. A ring gear member used for driving the cylinder rotatably during the printing process is provided at one end 42 of the cylinder segment. Smaller gears 44, 46 at opposite ends of the cylinder provide power to ductor cams of a moisture dispensing assembly (not shown) used in the offset press in which the master cylinder is mounted.

Figure 2:
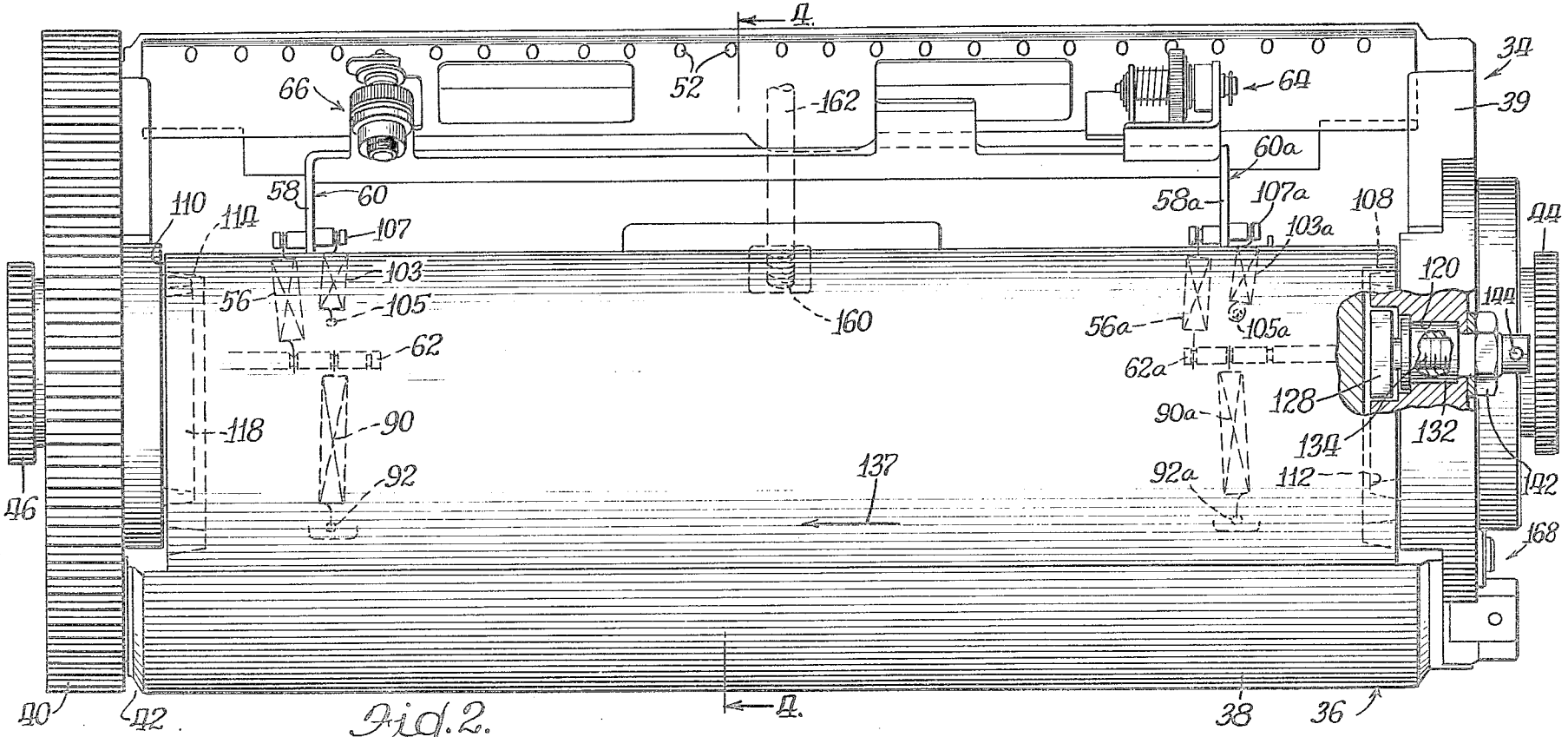
FIG. 2 is a plan view of a master cylinder including a master receiving cylinder surface extension according to the invention for changing the length of the master receiving surface of the cylinder.
Figure 5:
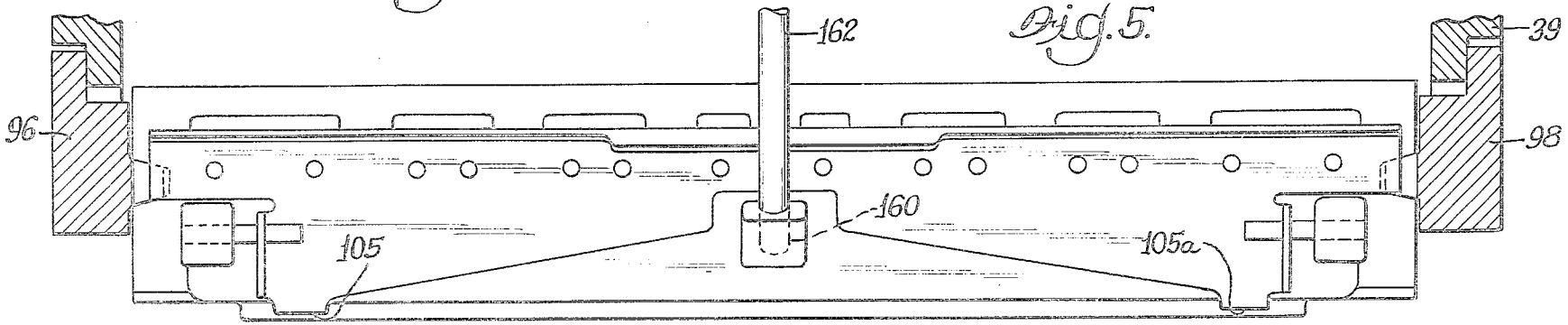
FIG. 5 is a sectional view of the master cylinder of FIG. 4*a* taken along the line 5—5 thereof.

A head clamp assembly 48 is provided at a first end 50 of the stationary master receiving surface of the cylinder segment 36. The clamp assembly is of a conventional design to permit the receipt of the leading end of a master sheet either of the type having a plurality of apertures formed along the lead end thereof or one with no apertures. In the former case, pins 52 of the clamping assembly are received in the apertures to secure the lead end of the master sheet. In the latter case, the lead end of the sheet is held by the clamping member 54. Holding force on the last-mentioned member is provided by springs 56, 56*a* coupled at first ends to the ends 58, 58*a* of arms 60, 60*a* of the clamp assebmly extending at opposite ends thereof into the interior of the cylinder (See FIG. 2) and at the opposite end to posts 62, 62*a* extending from the end walls into the interior of the cylinder. Thumb wheel adjustment devices 64, 66 are provided on the clamp assembly. One of the devices shifts the pin holding member and clamp 54 laterally to accommodate wider master sheets received on the cylinder since the apertures thereof are normally not in alignment with those apertures of the standard size sheet. It should be noted, that the width of the master cylinder is sufficient to accommodate both the standard 10 inches wide and longer 12.75 inches wide master sheets.

Figure 4:
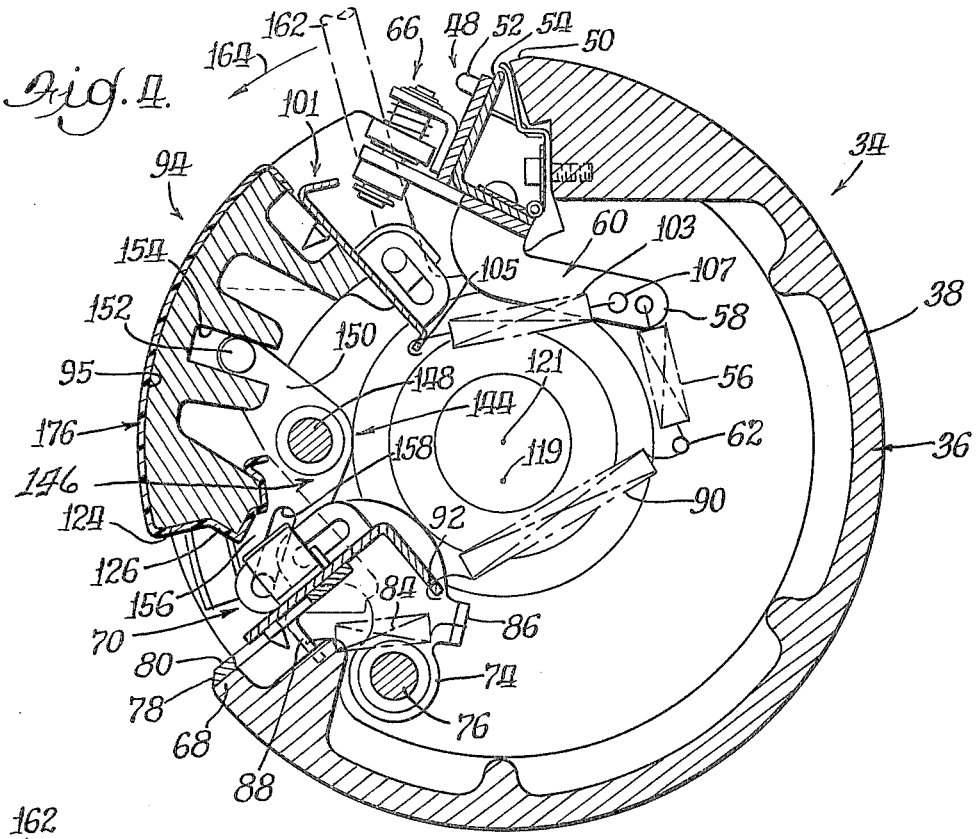
FIGS. 4 and 4*a* are sectional views of the master cylinder of FIG. 2 taken along the line 4—4, illustrating the two positions of the master receiving cylinder surface extension section for accommodating both standard and longer length master sheets, respectively.
Figure 4A:
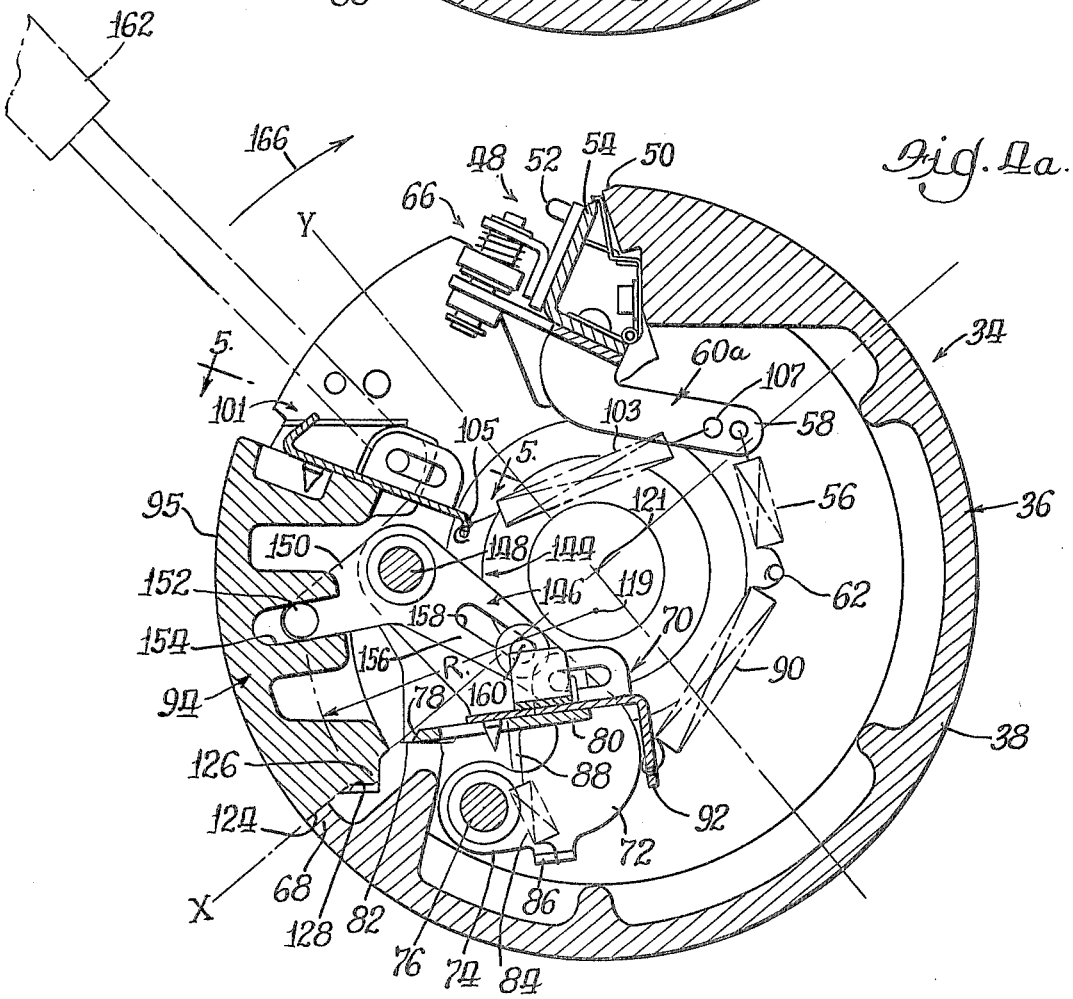

At the opposite end 68 of the stationary master receiving cylinder segment 36, approximately 240° about the cylinder, there is provided a tail clamp assembly 70 also of a conventional design except that the clamp assembly 70 is mounted for pivotal movement from an operative position, shown in FIG. 4, to an inoperative position, shown in FIG. 4*a* of the drawings. The arm 72 upon which the clamp assembly 70 is mounted is pivoted at one end 74 about shaft 76 extending axially through the cylinder. The clamp includes an anvil edge 78 formed on the plate portion 80 thereof which, when the clamp is in the operative position, is located adjacent end 68 of the stationary master sheet receiving segment 36 to protect the latter. Plate portion 80 is moved along a guide surface 82 (See FIG. 4*a*) during movement thereof between the operative and inoperative positions to insure correct alignment of the clamping assembly adjacent end 68 of the segment 36.

The tail clamp assembly 70 like head clamp assembly 48 is adapted to receive master sheets having apertures and those without apertures. Clamping force for the assembly 70 is provided by springs 90, 90*a* (See FIG. 2) attached at a first end to posts 62, 62*a*, respectively, and at the opposite ends to clamp ends 92, 92*a*, respectively. Second springs such as 84 are attached at first ends to tabs such as 86 extending from arms such as 72 and at the opposite ends to tabs such as 88 extending from anvil plate 80 to hold the latter against vibrations during rotation of the master cylinder when the clamp assembly is in the inoperative position shown in FIG. 4*a* and to hold the anvil section thereof against the edge receiving surface 68 of the cylinder segment when in the operative position (FIG. 4*a*).

To extend the master receiving surface of the cylinder to accommodate "long" master sheets, there is provided a master receiving cylinder surface extension section, designated generally by the numeral 94. The surface extension section is arcuately shaped to conform to the curvature of cylinder 34 and is formed of a cast iron, aluminum or the like metal similar to that of the stationary cylinder segment 36. The section includes a master receiving surface 95 which forms an extension to the surface 38 of the stationary cylinder segment 36 when the section 94 is in an operative position adjacent the segment 36.

Figure 7:
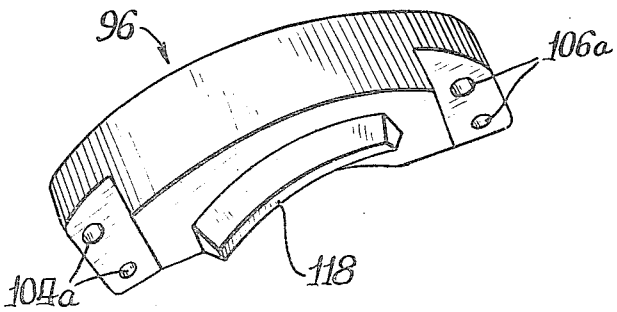

The master receiving cylinder surface extension section 94 is mounted on the master cylinder body by means of end plates 96, 98 which are held by suitable fasteners 100, 102 passing through the end plates in holes such as 104, 104*a*, and 106, 106*a*, respectively, (See FIGS. 7 and 8) provided therein to the main cylinder segment 36 at end plates such as 39 thereof.

Figure 6:
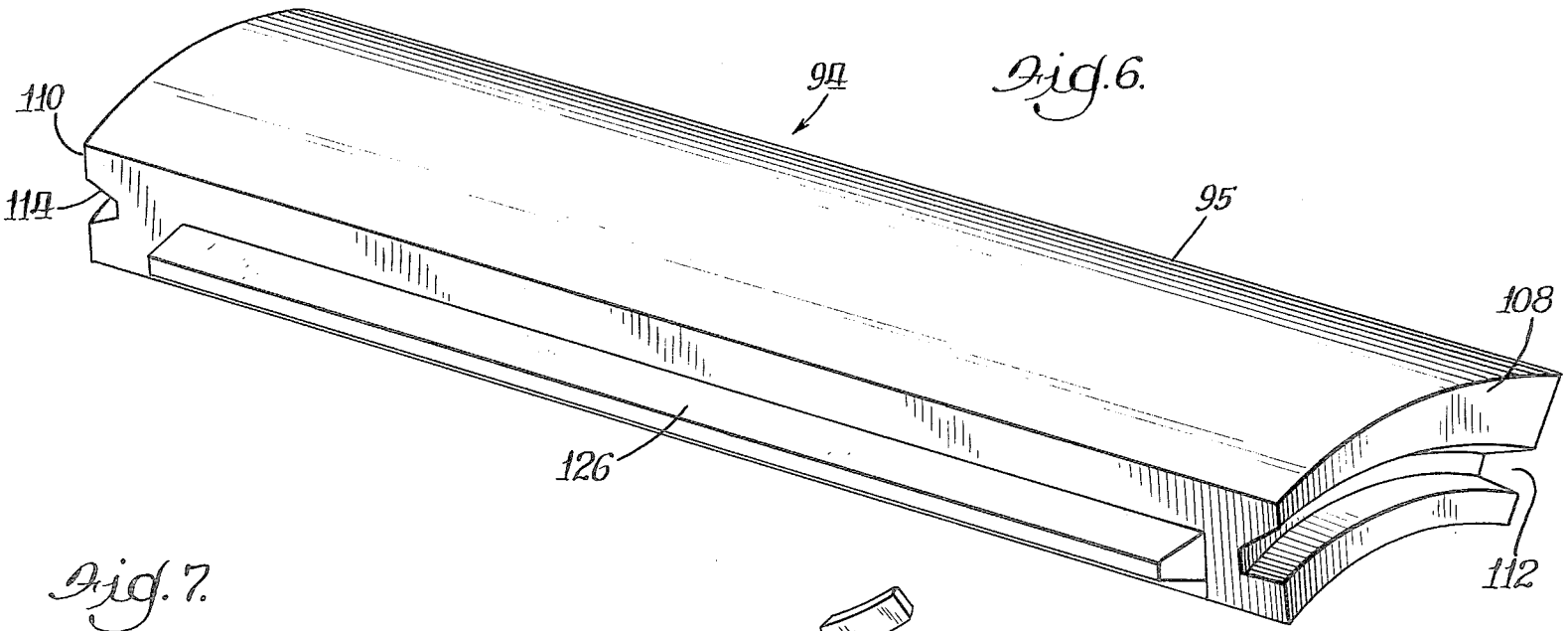
FIG. 6 is a perspective view of the master receiving cylinder surface extension section according to the invention.

The cylinder surface extension section has formed at each end 108, 110 thereof a groove 112, 114, respectively (See FIG. 6). Each of the end plates 96, 98 includes a complementarily formed tongue or protrusion 116, 118, respectively, which is received in a corresponding groove upon mounting the section between the end plates 96, 98.

Figure 3:
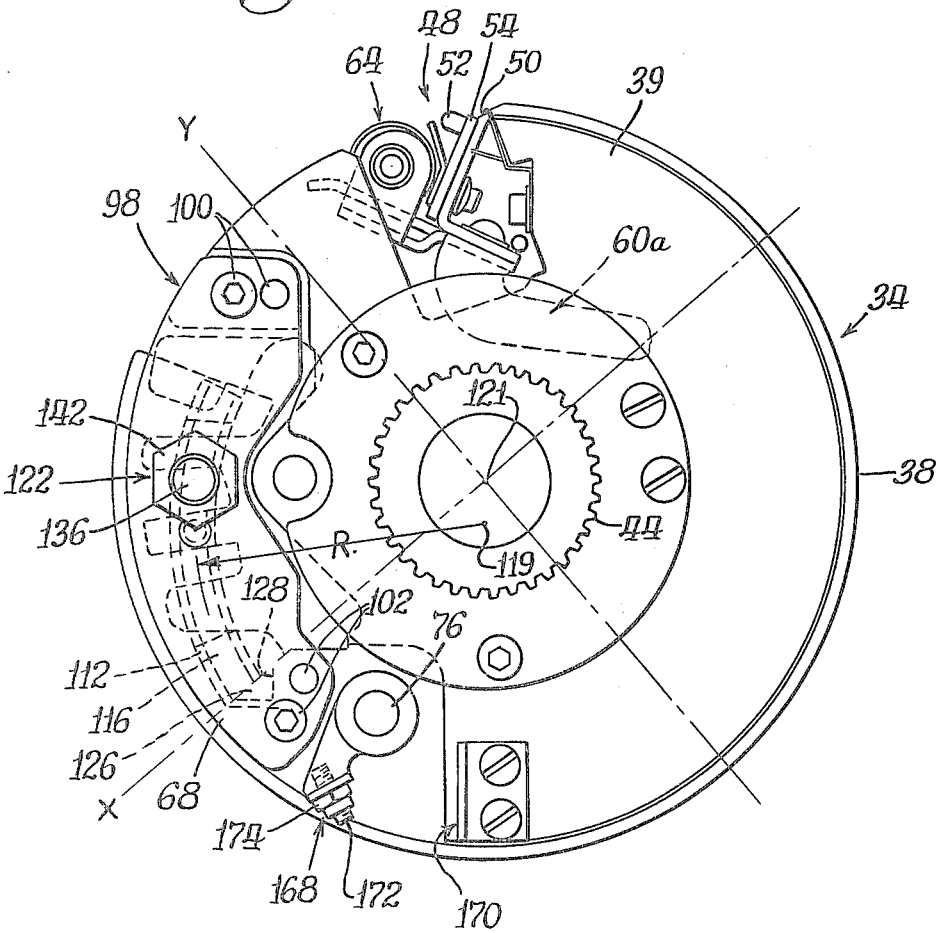
FIG. 3 is an end view of the master cylinder of FIG. 2.

The section 94 is slidable along the guides 116, 118 between an inoperative position (FIG. 4) and an operative position (FIG. 4*a*). When the end plates are attached to the master cylinder segment 36, the guides comprise the arc of a circular cross section of the cylinder formed by the radius R, see FIG. 3, extending from a center point 119 offset with respect to the center of rotation 121 of the master cylinder, to the tail end 68 of the stationary cylinder segment 36. More precisely, the center of rotation of the circle of which the arcuate guides 116, 118 are a part, is provided in the third quadrant of the circular cross section of the master cylinder (See FIG. 3) formed when the X coordinate passes along an imaginary line extending through the tail end 68 of the stationary master receiving cylinder segment 36 and the axis of rotation of the cylinder 121 with the one end 68 of the cylinder surface being located on the X coordinate between the third and fourth quadrants of the circular cross section.

Mounting the extension section 94 in this manner permits the section to be effectively rotated about the center 119 from an inoperative position wherein the section is stored in the interior of the cylinder (FIG. 4) to an operative position wherein the end 124 of the section engages end 68 of the stationary cylinder segment 36 (FIG. 4*a*) to provide a continuation of the master receiving surface 38 of the cylinder. Other guide means along which the extension section is moved into and out of the operative position of FIG. 4*a* can be substituted for those described herein and still fall within the scope of the invention. The guide 116, 118 illustrated, however, provide a convenient, relatively simple, reliable arrangement for moving the extension section as described.

Also included on section 94 is a tongue portion 126 extending the length thereof. The tongue portion 126 is provided for receipt in a cmplementarily shaped groove 128 formed in the end 68 of the stationary master sheet receiving segment 36 to align the surface 38 of the segment 36 with the surface 95 of the movable section 94 when the latter is moved into position as shown in FIG. 4*a* and to provide support to the section 94 when in use.

Figure 8:
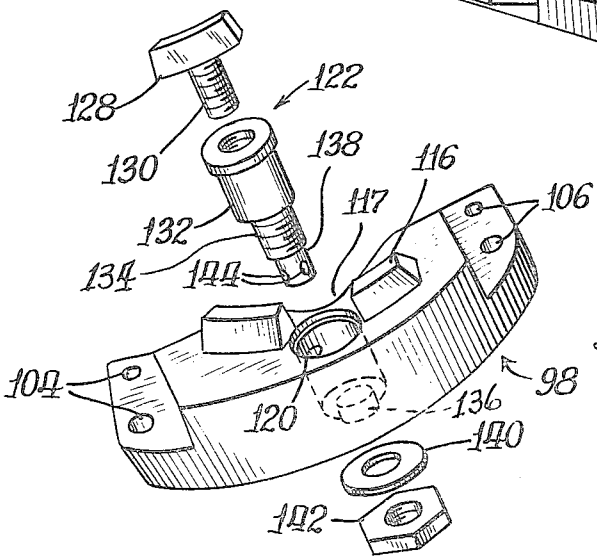
FIGS. 7 and 8 are end plates used for mounting the cylinder surface extension section of FIG. 6 onto the master cylinder member, including guide surfaces along which the cylinder surface extension section moves.

It will be noted that the tongue 116 of the end plate 98 has a separation 117 therein (See FIG. 8). A hole 120 defined therein passes through the plate 98 as shown. A locking assembly 122 is received in the hole 120 and passes between the adjacent tongue portions 116 of the plate 98. The locking assembly is provided to secure the cylinder surface extension 94 in either of the operative and inoperative positions.

Referring to FIG. 8, the locking assembly 122 includes a T-shaped tongue portion 128 having a left hand threaded end 130 which is received in a bushing member 132 provided with complementary female threads. The bushing member 132 is received in aperture 120 of a first diameter in the end plate 98. The opposite end 134 of the bushing is threaded and is received in a smaller diameter, concentrically formed aperture 136 and along with the extreme end 138 of the bushing passes through the plate and extends outwardly therefrom at the opposite side so that it is accessible from the exterior of the master cylinder. A washer and nut 140, 142 respectively, are connected to the bushing end 134 to secure the assembly in place.

To operate the locking assembly so as to free up the section 94 for movement from one position to the other, nut 142 is first loosened. Thereafter, a rod-like tool (not shown) is inserted into one of the small apertures, such as 144, in the end 138 of the bushing 132. The end 132 is rotated thereby to in turn loosen the left-handed thread connection of bushing 132 and the T-shaped tongue portion 128, moving the last-mentioned portion away from the end 108 of the section 94. The latter releases the pressure applied by the tongue portion 128 against the end 108 of the extension section 94 freeing the section for movement along guides 116, 118. When the section has been moved to a desired position, the rod-like tool is again inserted into one of the apertures 144 to drive the tongue portion 128 into engagement with end 108 in groove 112, moving the section slightly in the direction of arrow 137 (See FIG. 2) against tongue 118 of end plate 96. In this manner, the section is held securely between tongue 118 and tongue portion 128.

Also included on extension section 94 at the end thereof opposite end 124, is an auxiliary tail clamp assembly 101. The tail clamp assembly 101 is similar to the clamp assembly 70, functioning in a like manner. Biasing force for the tail clamp assembly is provided by springs 103, 103*a*, on opposite ends of the cylinder (FIG. 2) coupled to the clamp assembly at first ends 105, 105*a*, respectively, and to the arms 60, 60*a*, respectively, of clamp assembly 48 at ends 107, 107*a*, respectively, thereof. The springs also prevent the clamp from moving toward the periphery of the cylinder when the extension section 94 is not in use.

A resilient plastic or the like section cover 176 is snapped over the surface 95 of the extension section 94 to protect the latter when the section is in an inoperative or stored position as shown in FIG. 4*a*.

In a preferred embodiment of the invention, means 144 are provided to simultaneously move the extension section 94 from an inoperative to an operative position and the sheet tail clamp assembly 70 from an operative to an inoperative position. The means 144 include a pair of bell cranks, only one 146, of which is shown in the drawings (See FIGS. 4, 4*a*). The bell crank 146 is mounted for rotation on shaft 148 extending through cylinder 34 parallel to the axis thereof. A first arm 150 of the bell crank includes a pin 152 at the end thereof which is received for sliding movement at an opened slot 154 in the extension section 94.

The other arm 156 of the bell crank has a slot 158 formed therein in which there is received a pin 160 extending from the end of arm 72 on which clamp assembly 70 is mounted for movement. Rotation of the bell cranks about shaft 148 caused by movement of the section 94 between the inoperative and operative positions, imparts pivotal movement to the clamp assembly 70 to in turn move it between its operative and inoperative positions, respectively.

To move the section between positions, a tool receiving aperture 160 is defined in section 94 at the end thereof adjacent auxiliary tail clamp assembly 101. An elongated rod-like tool 162 is inserted into aperture 160 and the tool is moved in the direction of arrows 164, 166, respectively, (See FIGS. 4, 4*a*) to in turn move the extension section between its operative and inoperative positions.

To insure the correct movement of the section 94 and tail clamp assembly 70, motion limiting member 168 (See FIG. 3) is mounted on an extension of shaft 76 on which the clamp assembly 70 is pivoted. The member 168 is mounted on the exterior of the cylinder end and is rotatable with the clamp assembly 70. A stationary anvil surface 170 is bolted onto end plate 39 of the cylinder. A threaded pin portion 172 is held onto member 168 by a lock nut 174. The pin portion 172 engages anvil surface 170 upon moving the clamp assembly 70 into an operative position. The engagement of the surface by portion 172 limits the movement of clamp assembly 70 to insure proper positioning thereof adjacent anvil edge 78 of plate portion 80 relative to end 68 of segment 36 and limits the travel of extension section 94 into the inoperative position. Adjusting the protusion of pin portion 172 toward and away from anvil surface 170 controls the limit of movement of the clamp assembly 70 to an operative position as well as defining the limit of movement of section 94 to the storage position.

The master cylinder 34 according to the invention provides for a relatively simple and easily accomplished change in the master sheet receiving surface length of the cylinder when desired. Assuming the extension section is in the stored or inoperative position shown in FIG. 4, the steps for moving the section 94 into the operative position of FIG. 4*a* are as follows:

The protective cover 176 overlying the surface of section 94 is removed therefrom. Thereafter nut 142 of the locking assembly is loosened with a suitable wrench or the like tool (not shown). The loosening of the nut permits the left hand threaded T-shaped tongue section 128 to be withdrawn from groove 112 in end 108 of the extension section by insertion and rotation of a suitable tool in aperture 144 thereof. When the latter is accomplished, section 94 is free to be moved along guides 116, 118, to the operative position adjacent end 68 of the stationary master receiving surface segment 36.

Tool 162 is inserted into aperture 160 in the extension section 94 and is moved in the direction of arrow 164 (See FIG. 4) to pivot the section 94 about point 119 along guides 116, 118 until the tongue portion 126 is received in the groove 128 of end 68 of the segment 36. Simultaneously with the movement of section 94 into the operative position, bell crank 146 is rotated, driving clamp assembly 70 pivotally into the confines of the cylinder 34 out of the path of section 94.

Once the section 94 is in the operative position of FIG. 4*a*, T-shaped tongue section 128 is tightened against end 108 of the section 94 to urge the section 94 against tongue 118 thereby securing the section in place. Thereafter, lock nut 142 is tightened to secure the locking assembly in a locked condition. At this time, cylinder 34 is ready to receive a long master sheet for printing.

When it is desired to change the surface again to accommodate standard master sheets, the procedure is again carried out reversing the movement of section 94 by means of the tool 162.

It should be noted that while the preferred embodiment of the master cylinder includes a bell crank arrangement to simultaneously move the section 94 and clamp assembly 70 between their inoperative and operative positions, respectively, other suitable means may be provided to accomplish the latter or alternatively no interconnecting means need to be provided. Instead, the section 94 and clamp assembly 70 may be moved separately, the extension section being moved by the tool 162 and the clamp assembly 70 by rotation of limiting member 168 from the exterior of the cylinder.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What I claim is:

1. A master cylinder assembly for an offset or the like printing press including in combination: a hollow cylindrical member having a stationary master receiving surface of a predetermined length extending less than 360° about the periphery thereof, lead and trailing end master sheet holding means at opposite ends of said master receiving surface, one of said holding means mounted for movement between a first position adjacent a first end of said master receiving surface for accommodating a master sheet of a first predetermined length and a second position internally of said cylinder member away from said first end of said master receiving surface, and an arcuate master receiving cylinder surface extension section mounted for movement between a first position internally of said cylinder when said one holding means is in said first position, and a second position in engagement with said first end of said stationary master receiving surface when said one holding means is in said second position for providing an extension of said master sheet receiving surface to accommodate a master sheet of a second predetermined length, greater than said first predetermined length.

2. A master cylinder assembly as claimed in claim 1 wherein said hollow cylindrical member is mounted for rotation about a central axis and wherein said arcuate master receiving cylinder surface extension section is mounted for effective arcuate movement about a point off center with respect to the rotatable axis of said cylindrical member.

3. A master cylinder assembly as claimed in claim 2 wherein said point is positioned in the third quadrant of a circular cross section of said hollow cylindrical member when the X coordinate is taken along an imaginary line passing through said first end of said stationary master receiving surface and the axis of rotation of said hollow cylindrical member and the Y coordinate is taken along an imaginary line passing through the axis of rotation of said hollow cylindrical member, perpendicular to said X coordinate, with said first end of said stationary master receiving surface being located on said X coordinate between said third and fourth quadrants as defined by said X and Y coordinates.

4. A master cylinder assembly as claimed in claim 1 further including means coupled to said arcuate master receiving cylinder surface extension section and said one master sheet holding means, said means being movable between first and second positions for moving one of said one sheet holding means and said arcuate master receiving cylinder surface extension section to a position adjacent said first end of said master cylinder in response to the movement of the other of said one sheet holding means and said arcuate master receiving cylinder surface extension section to a position internally of said cylinder and vice versa, respectively.

5. A master cylinder assembly as claimed in claim 4 wherein said movable means include a pivotally mounted member having first and second arms extending outwardly therefrom, a first arm being coupled to said arcuate master receiving cylinder surface extension section and the second arm being coupled to said one sheet holding means, said pivotally mounted member imparting movement to said one sheet holding means to move the latter to a first position upon movement of said master receiving cylinder surface extension section to said first position and vice versa.

6. A master cylinder assembly as claimed in claim 1 further including locking means for locking said master receiving surface extension section in said first and second positions, respectively, said locking means being releasable to permit movement of said surface extension section between said positions.

7. A master cylinder assembly as claimed in claim 6 wherein said master receiving surface extension section is mounted on guide members provided on said cylinder member, the curvature of said guide members being arcuate about a central point eccentric with respect to the axis of rotation of said cylinder member, and wherein said locking means is operable for urging said extension section into frictional engagement with at least one of said guide members, thereby preventing movement of said extension section thereby.

8. A master cylinder assembly as claim in claim 7 wherein one of said guide members defines an aperture therein and wherein said locking means includes a locking member having a guide portion passing through said aperture, said locking member being extendable toward and away from said master receiving surface extension section for engagement and disengagement with said section, said last-mentioned section being locked into position upon said guide portion engaging said section and release for movement along said guide members upon disengagement thereof.

9. A master cylinder assembly as claimed in claim 1 further including extension section mounting means, said mounting means including a pair of side members coupled to said cylinder member at opposite ends thereof, one of said pair of side members and the ends of said extension section opposing said side member, respectively, having arcuate guides formed therealong and the other of said pair of side members and the ends of said extension section opposing said side members, respectively, having defined therein complementarily shaped grooves for receiving said guide members, whereby said extension section is slidable on said guide members between said first and second positions.

10. In an offset or the like printing press comprising a master cylinder mounted for rotation about the central axis thereof and having a fixed master sheet receiving surface extending less than 360° about the periphery thereof with a sheet clamp assembly mounted at each end for receiving a master sheet on said surface, a blanket cylinder mounted for rotation in substantially contacting engagement with said master cylinder for receiving a visible image on the surface thereof from said master sheet and an impression cylinder mounted for rotation in engagement with said blanket cylinder for urging sheet material fed between said blanket and impression cylinders into engagement with the blanket cylinder for transferring said image thereto, means included on said master cylinder for extending the master receiving surface thereof for accommodating master sheets of a length greater than those accommodated by said fixed master sheet receiving surface, said means including a master sheet receiving surface extension section mounted on said cylinder for movement between an operative position adjacent a first end of said fixed master sheet receiving surface and an inoperative position internally of said cylinder, said extension section having a peripheral surface being arcuately shaped to conform to the curvature of said fixed master sheet receiving surface when said section is in said operative position.

11. A master sheet receiving cylinder surface extension means as claimed in claim 10 wherein a first one of said sheet clamps adjacent said first end of said fixed master sheet receiving surface is mounted for movement away from said end into the confines of said cylinder to permit movement of said master sheet receiving surface extension section into said operative position, said surface extension section including an auxiliary clamp mounted thereon at the end thereof away from said first end of said fixed master sheet receiving surface for accommodating said master sheets of greater length.

12. A master sheet receiving cylinder surface extension section as claimed in claim 11 further including bell crank means mounted for pivotal movement on said cylinder member and coupled at a first arm thereof to said cylinder surface extension section and at the second arm thereof to said first one of said sheet clamps whereby upon movement of said surface extension section from said inoperative to said operative position, said sheet clamp is moved by said bell crank away from said first end of said fixed master sheet receiving surface, into the confines of said cylinder.

13. A master sheet receiving cylinder surface extension section as claimed in claim 11 wherein said one sheet clamp includes movement limiting means for controlling the movement of said first clamp into position adjacent the first end of said fixed master sheet receiving surface, said movement limiting means including a stationary limiting surface mounted on said cylinder member and a movable member coupled to said first clamp, said movable member engaging said stationary limiting surface upon movement of said first clamp from said position within the confines of said cylinder to said position adjacent the first end of said fixed master sheet receiving surface.

14. A master sheet receiving cylinder surface extension section as claimed in claim 10 wherein said extension section is mounted for effective rotation between the operative and inoperative positions about a predetermined point internally of said cylinder, offset with respect to the axis of rotation thereof.

15. A master sheet receiving cylinder surface extension section as claimed in claim 14 wherein said effective predetermined point about which said extension section is rotatable is positioned in the third quadrant of a circular cross section of said hollow cylindrical member when the X coordinate is taken along an imaginary line passing through said first end of said fixed master sheet receiving surface and the central axis of said master cylinder with said first end of said cylinder lying in said X coordinate between said third and fourth quadrants.

16. A master sheet receiving cylinder surface extension section as claimed in claim 10 further including a pair of mounting plates coupled on opposite ends of said cylinder, respectively, one of said pair of mounting plates and the ends of said cylinder surface extension section opposite said plates, respectively, including tongue portions extending therefrom and the other of said pair of mounting plates and the ends of said cylinder surface extension section opposite said plates, respectively, defining complementarily shaped grooves for receiving said tongue portions, said tongue portions and grooves being arcuately shaped along a curvature formed by the movement of a predetermined radius pivoting about a predetermined point within said cylinder, offset with respect to the axis of rotation thereof, said cylinder surface extension section being slidable along said tongue portions between said operative and inoperative positions.

17. A master sheet receiving cylinder surface extension section as claimed in claim 16 further including locking means operable to locked and released conditions, respectively, said locking means in said locked condition urging said extension section laterally for frictionally engaging one of said tongue portions in a corresponding groove whereby movement of said extension section is prevented.

* * * * *

UNITED STATES PATENT OFFICE
CERTIFICATE OF CORRECTION

Patent No. 4,018,158 Dated April 19, 1977

Inventor(s) Lawrence A. Borneman

It is certified that error appears in the above-identified patent and that said Letters Patent are hereby corrected as shown below:

Column 2, line 62 should read:

"various views to designate similar components, there is "

Column 3, line 62 should read:

"assembly extending at opposite ends thereof into the"

Column 5, line 34 should read:

"provided for receipt in a complementarily shaped groove"

Column 7, line 8 should read:

"protrusion of pin portion 172 toward and away from"

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*